US006773206B2

(12) United States Patent
Bradley et al.

(10) Patent No.: US 6,773,206 B2
(45) **Date of Patent: *Aug. 10, 2004**

(54) SUPPORT PILE REPAIR JACKET FORM

(76) Inventors: Michael S. Bradley, 511 23rd. St. NW., Naples, FL (US) 34120; Monica K. Bradley, 511 23rd. St. NW., Naples, FL (US) 34120

( * ) Notice: Subject to any disclaimer, the term of this patent is extended or adjusted under 35 U.S.C. 154(b) by 0 days.

This patent is subject to a terminal disclaimer.

(21) Appl. No.: 10/094,904

(22) Filed: Mar. 12, 2002

(65) Prior Publication Data

US 2002/0094239 A1 Jul. 18, 2002

Related U.S. Application Data

(63) Continuation-in-part of application No. 09/656,919, filed on Sep. 7, 2000, now Pat. No. 6,364,575.

(51) Int. Cl.[7] ..... E02D 5/60

(52) U.S. Cl. ..... 405/215; 405/211; 52/514; 52/514.5

(58) Field of Search ..... 405/231, 211, 405/216, 211.1, 212; 52/514, 514.5

(56) References Cited

U.S. PATENT DOCUMENTS

| | | | | |
|---|---|---|---|---|
| 931,318 | A | * | 8/1909 | Knapen |
| 1,947,413 | A | * | 2/1934 | Hay |
| 3,719,049 | A | * | 3/1973 | Shaw et al. |
| 4,072,022 | A | * | 2/1978 | Shimizu |
| 4,244,156 | A | * | 1/1981 | Watts, Jr. |
| 4,512,683 | A | * | 4/1985 | Cosenza |
| 4,764,054 | A | * | 8/1988 | Sutton |
| 4,963,058 | A | * | 10/1990 | Broughton et al. |
| 5,435,667 | A | * | 7/1995 | Strange |
| 6,048,136 | A | * | 4/2000 | Denison et al. |
| 6,113,313 | A | * | 9/2000 | Blair et al. |
| 6,364,575 | B1 | * | 4/2002 | Bradley et al. |

FOREIGN PATENT DOCUMENTS

JP 61-196026 * 8/1986 ..... E02D/31/06

OTHER PUBLICATIONS

Article "The marketplace: Pile Encapsulation and Repair Products" Reprint from "Underwater Magazine", Summer 1996, from http://www.diveweb.com/uw/archives/arch/uw–su96.26.htm; 7 pages.*

Pile Protector™ Brochure © 1999, from Merco Marine, http://www.mercomarine.com/pile_protector.htm; 2 pages.*

Brochure A–P–E FRP Jackets © 2000, from MADCON Corp; http://www.madconcorp.com/frpjacket.asp; 2 pages.*

Brochure Corroseal XLP Timber Pile Cladding System, from http://www.corroseal.com.au/PILES.htm; 7 pages.*

Brochure, Tapecoat TC Enviroshield Marine Products, from http://www.tapecoat.com/pages/marine.html; 3 pages.*

* cited by examiner

*Primary Examiner*—Robert J. Sandy
*Assistant Examiner*—Katherine Mitchell

(57) ABSTRACT

A plastic jacket that is used for repairing underwater or on ground support piles that have corroded by the wave action at the water line, by a tidal zone or natural salty air corrosion, respectively. The jacket consists of a cylindrical wall having annular corrugations on its exterior surface. The cylindrical wall has a longitudinal cut along its length to exhibit two opposing edges. A seal is placed between the opposing edges. Opposite from the longitudinal cut there is a V-shaped through the corrugations to the cylindrical wall to create a living hinge in the plastic material of the wall. Banding is provided to pull the opposing edges into a tight relationship and trapping the seal there between. The V-shaped cuts enable the jacket to be opened and placed around a damaged pile in spite of the corrugations which prevent such an opening. It is preferred that the material of the jacket be made of a transparent material. This way, when the any flaws, such as voids, develop within the poured concrete they can be observed through the transparent material and can be eliminated or corrected immediately.

23 Claims, 9 Drawing Sheets

SUPPORT PILE REPAIR JACKET FORM

CROSS REFERENCE TO RELATED APPLICATION

This application is a Continuation-In-Part of the prior application under the Ser. No. 09/656,919 filed on Sep. 07, 2000 now U.S. Pat. No. 6,364,575.

BACKGROUND TO THE INVENTION

The invention relates to a pile repair jacket form being useful in repairing bridge, pier or walkway supports that are submerged in a body of water or above the ground. Walkways such as piers or boardwalks are supported over a body of water or above the ground by way of piles that have been driven into the bottom of the body of water below the mud line or simply into the ground. Such piles can consist of concrete, timber and steel. It is obvious that the concrete, timber and steel piles are subject to corrosion or deterioration because of being permanently located in a water environment. Concrete piles are subject to corrosion, especially if the steel re-bars located therein are subject to rusting if they are located too close to the outer surface of the concrete pile or are exposed altogether. The timber piles are always pressure treated against corrosion or deterioration but the time span of their useful life is substantially shortened when the timber piles are located in a body of water. Steel piles are water proofed prior to their installation but over a period of time the water proofing is not durable or protective enough to protect the steel from corroding.

Most of the damage in all of the above supporting piles occurs at the water line because of the wave action. This wave action is further aggravated by the tides which are prevalent at most installations. In many installations, the high tide covers a greater height of the pile, while at a low tide, a greater length of the pile is exposed to the environment. Therefore, the piles undergo drying and wetting cycles which tend to eat away at the pilings, especially the wooden piles, thus weakening the piles mostly at their mid sections of their total length. Also, water insects like marine borers tend to accelerate the above noted deterioration and are the leading cause of timber pile deterioration. The above noted problems are not as prevalent with support piles that have been driven into the ground, mainly to support buildings or houses. It is noted that, especially at shore lines, houses or dwellings are supported on so-called stilts. These stilts are subject to some wave action, especially at high tides but are normally kept out of the water action. If not subjected to any water action, the corrosive and salty air does contribute to a corrosive action and thereby destroying action over a longer period of time. The support piles can be repaired in situ without having to remove the supported superstructure.

Many devices have been used to repair the above noted damages short of replacing the pilings altogether. This tends to substantially increase the cost of such an installation.

The DENSO™ North America Corp. teaches the use of fiber form jackets that are placed over the whole length of the pile to be repaired or over the damage at the tidal zone. The jacket is made of fiber glass and therefore has some flexure in the material, especially over greater lengths. Because of its ability to flex, the jackets can be installed at the desired location without having to disassemble the superstructure above the piles. Once in place, the jackets at their longitudinal open edges have a tongue and groove arrangement to close and seal the longitudinal edges. Bandings are placed around the jacket at about every 12". Also standoffs between the pile and the interior surface of the jacket should be used to increase its stability. The use of fiberglass material is very expensive.

Another suggested use is demonstrated by the above noted corporation and that is the use of a fabric form jackets. The fabric form jacket is made of 100% continuous multifilament NYLON fibers and is placed around the damaged area of the pile and the top and the bottom is then closed against the pile by banding. A longitudinal zipper is then closed to complete a cylindrical enclosure. A disadvantage with this kind of an arrangement is that the cylindrical fabric form does not have a form stability in that when the concrete fill is inserted therein, it has a tendency to collect more concrete in the bottom of the cylinder and less at the top, whereby a pear-shaped form is assumed. Therefore, more concrete has to be used than is necessary. Hydraulic concrete is quite expensive. Also, the fabric form pile jacket itself is quite expensive.

A similar jacket system is disclosed by the ROCKWATER Corp. in Farmingdale N.Y. They disclose fiberglass reinforced pile jackets under the name of ROCKFORM™ F and a nylon Pile Jacket under the name of ROCKFORM™ N. As a matter of fact, there is an illustration in their brochure showing the nylon jacket installed on a pile after having been filled with concrete. This illustration clearly demonstrates the disadvantage of this type of a repair wherein more of the concrete is located in the bottom of the bag instead of being equally distributed throughout the length of the bag, as was enumerated above already.

Another form jacket is disclosed by the DESLAURIERS, Inc. company. The disclosed jacket consists of two halves that have to be bolted together at their respective flanges and therefore can be installed around existing piles without having to disturb the decking which is supported by the same. However, the assembly underwater is quite cumbersome, expensive and time consuming.

OBJECTS OF THE INVENTION

According to the invention, applicant is using a high density polyethylene HDPE pipe, which pipe has a smooth interior wall and an annular corrugated exterior for strength. This pipe is manufactured by the Advanced Drainage Systems, Inc. of Columbus, Ohio. High Density Polyethylene is an extremely tough material that can easily withstand the normal impacts involved in shipping and installation. The proposed applications for this pipe have been specified for culverts, cross drains, storm sewers, land fills and other public and private constructions. There is no proposal to use these pipes for repairing pile supports above water or below.

The pipe, as is, could be used for that purpose but only after the decking, which is supported by the pile, has been removed, and then the pipe could be slipped over and along the pile. However, this pipe cannot be used as a jacket in sections above and below water without first removing the decking or superstructure. In the inventive concept, the pipe has been modified for this purpose by cutting through the pipe longitudinally first. This cutting alone will not suffice because the annular corrugations prevent the pipe at its longitudinal cut to be opened to such an extent and size so that the jacket can easily be slipped around a damaged pile. The corrugations are of such a size and strength so as to not allow any such movement. To accommodate a proper opening, the casing or jacket has been cut in a V-shape and only through the corrugations and opposite the longitudinal cut but not into the wall itself that supports the corrugations and forms the interior smooth surface, thereby creating a live hinge. The HDPE material is flexible enough to allow repeated openings and closings of the jacket along its live hinge without breaking or separating. The corrugated pipe is readily available in diameters from 4 inches to 48 inches and therefore lends itself to many applications including in square concrete pile applications. The pipe also is available in various lengths which enhances the installation possibilities under water. If various lengths have to be assembled, the various sections can be supplied with bell- and spigot ends that fit well within each other including various seals between the sections.

As will be explained in more detail below, the pipe is normally delivered in a black color. It is also desirable to have the pipe made of a transparent material. This material allows for a view of the interior of the jacket when it is being filled with concrete. When filling a long pipe or tube with concrete, it can happen that voids form within the concrete, especially at the inner wall of the pipe. If not corrected, this will form voids in the formed concrete which would effect the quality and the performance of the installation. A transparent material allows a visual observation of the pouring of the concrete and observed flaws can immediately be corrected.

DETAILED DESCRIPTION OF THE INVENTION

Figure 1:
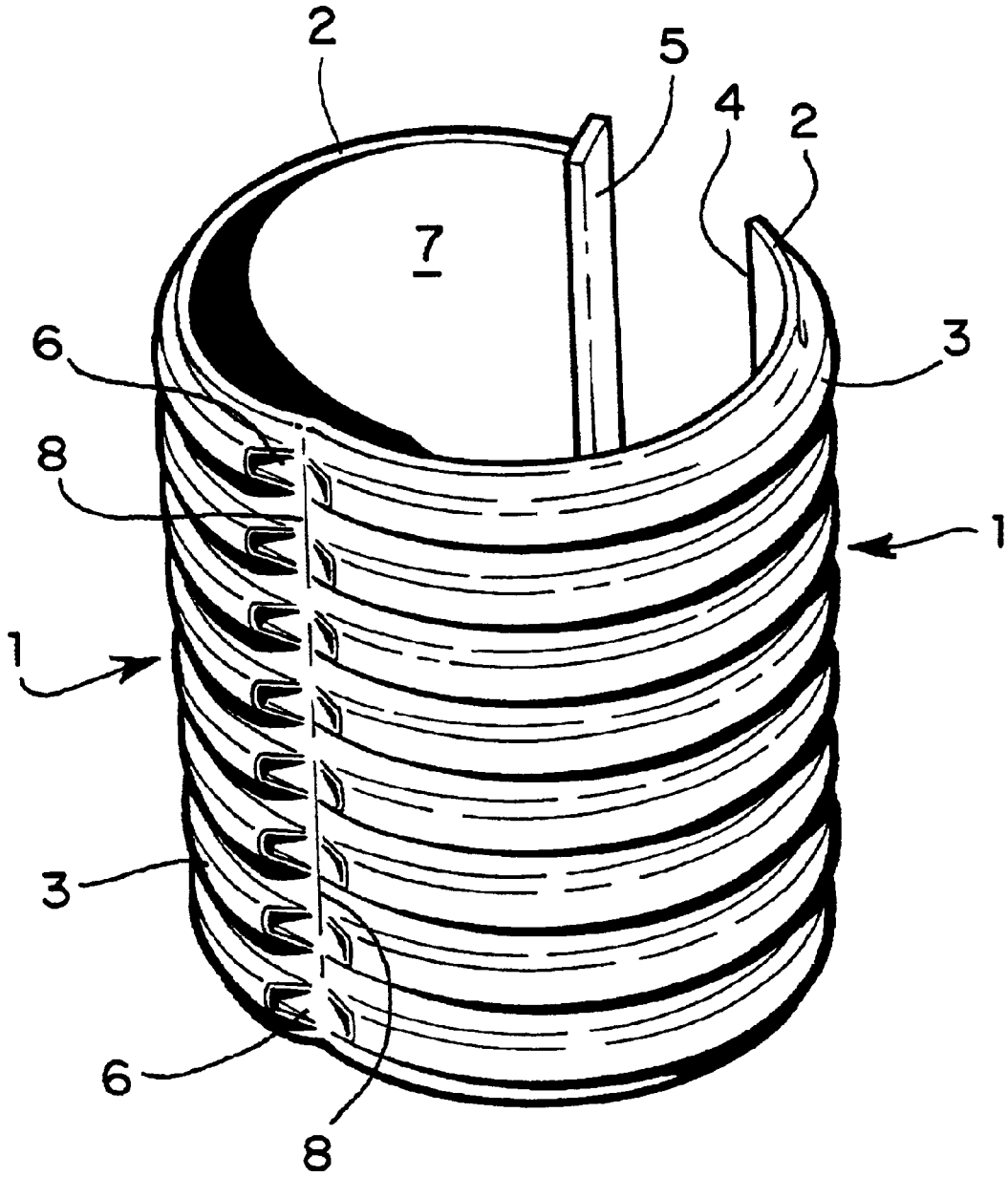
FIG. 1 is a perspective view of the pile repair jacket.

FIG. 1 illustrates the invention of the pile repair jacket as it has been modified from what is known in the prior art. The jacket is being identified as 1. The jacket 1 normally has a solid but somewhat resilient and circumferential wall forming a cylinder. Around the cylindrical wall a multiple of corrugations 3 are formed or molded to give the jacket a strong rigidity. The cylinder is being cut in a longitudinal direction to expose longitudinal edges 4. Opposite from the longitudinal edge 4 a V-shaped cut is made into the corrugations but only onto the straight cylindrical to maintain its integrity. This is shown at 6. The jacket 1 has a smooth interior wall 7 and an upper edge 2. This way a live hinge 8 is created by virtue of the wall being somewhat flexible because of the loss of the corrugations 3 at that particular point 8. It is now apparent that the former rigid cylinder may now be opened up so that it can be draped around a timber pile that is in need of a repair. If any larger diameter piles or supports within a body of water needs to be repaired, it is quite possible to cut at least three V-shaped cuts into the corrugations 3 down to the smooth wall so as not to over stress any individual live hinge in case that the jacket has to be opened rather wide to surround a large pile support such as could happen with square concrete piles. Once the jacket has been installed around a pile, the edges 4 have to be brought together again and sealed against each other. Therefore, a self-adhesive seal 5 has been provided between the edges 4 which will seal against water leaking into the jacket or concrete leaking out at a later time when the jacket is filled with concrete. The adhesive seal may consist of a soft foam rubber or some other flexible rubber. The seal is adhesive at least on one side so that it will firmly adhere to at least one of the edges 4 and cannot be dislodged.

Figure 2:
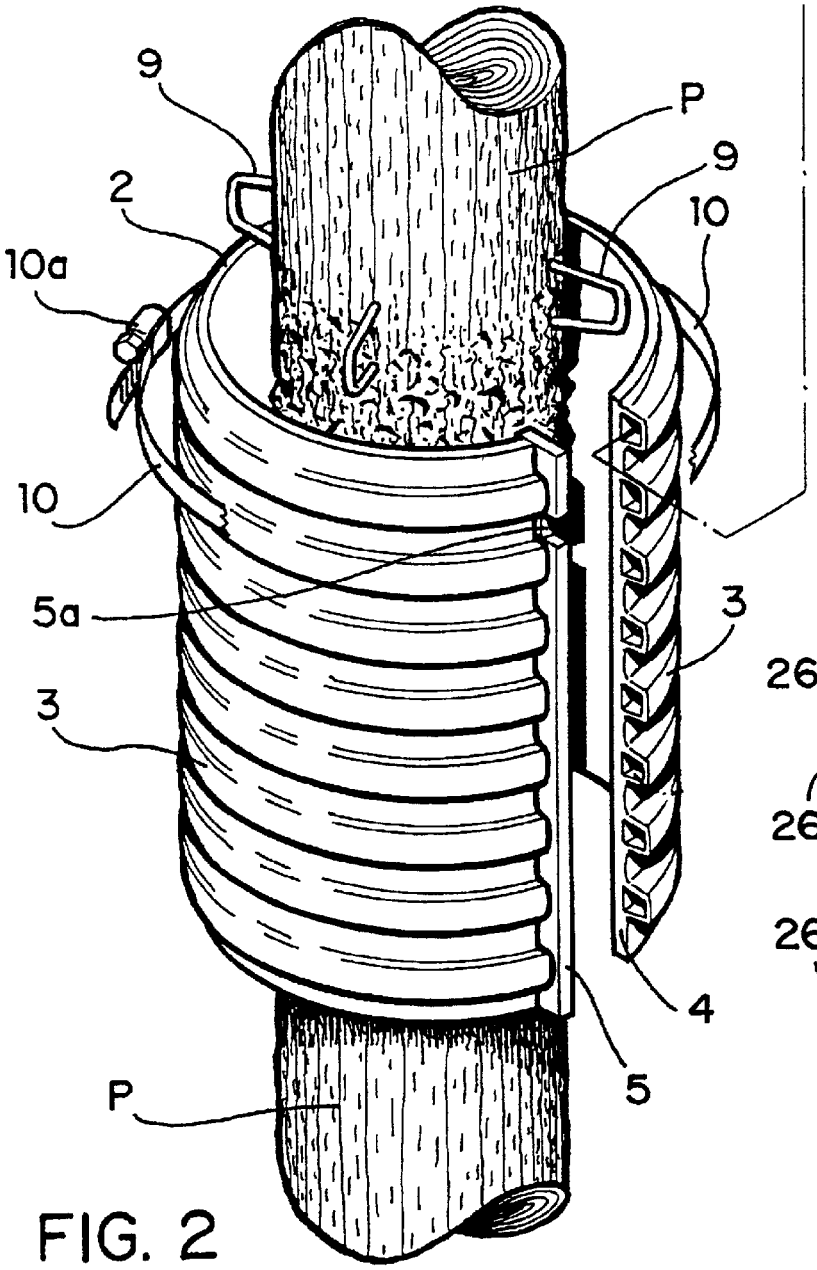
FIG. 2 is a perspective view of the jacket installed on a pile to be repaired.

FIG. 2 illustrates the jacket 1 after it is installed around a damaged area of the pile P. Like reference characters have been applied to like elements as explained in FIG. 1. In order to stabilize the interior wall against the pile P, standoffs 9 have been provided which are merely nailed into the pile P. The standoffs have been shown as U-shaped but can take many other forms. It is also noted that the standoffs should be made of a plastic material or other non-corrosive material, because if it is too close to the surface, once the concrete is cast and is cured, the standoff if it is made of metal, could be a cause for corrosion and/or rusting. In order to bring the outer circumference of the jacket 1 back into its original circular shape, the edges 4 are pulled together by banding 10 which will settle in annular grooves between the annular corrugations 3. The banding 10 shown in FIG. 2 is of the conventional ratchet type otherwise known as hose clamps in automobile engines, for example. The banding 10 is tightened within the groove by ratchet screw 10*a* which is well known. The seal 5 is shown as self-adhering to one of the edges 4. When the banding 10 is applied to the jacket 1, the seal 5 may have to applied with a notch 5*a* so that the banding 10 will not disturb the shape of the rectangular seal 5.

Figure 2A:
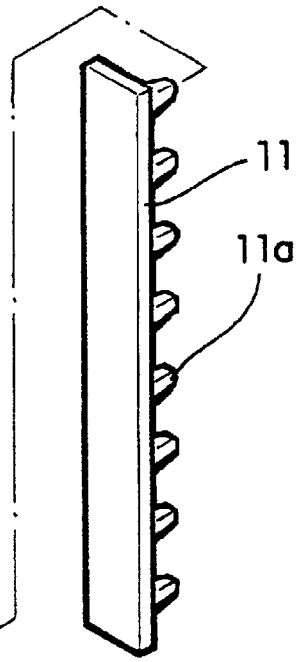
FIG. 2A is a perspective view of an alternative seal.

FIG. 2A illustrates another seal 11 which is not self-adhering but instead is supplied with plugs 11*a* which are formed in such a shape so that will snugly fit within the interior openings of the corrugations 3. This type of an arrangement will assure a longer lasting fit and could be reusable, while a self-adhering seal 5 will have a one time use only.

Figure 2B:
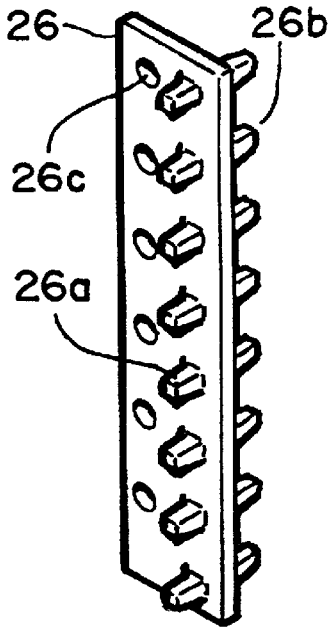
FIG. 2B is a perspective view of still another alternative seal.

FIG. 2B illustrates still another seal 26 which has plugs 26*a* and 26*b* on both sides of the rectangular seal 26. Additionally, the rectangular is somewhat enlarged so that it will extend into the interior of the jacket form 1. The extension into the interior of the jacket form has lateral holes 26*c* therein. When the jacket form 1 is being filled with concrete, the concrete will migrate into these holes to completely fill the same. Of course, the soft rubber seal of FIG. 2A would not be practical in this type of installation. It is preferred that the same material by used in this instance as was used to manufacture the jacket form 1 such as HDPE. All other seals disclosed above could have the same interior extensions as shown in FIG. 2B. This type of installation makes a very rigid fastening system.

Figure 3:
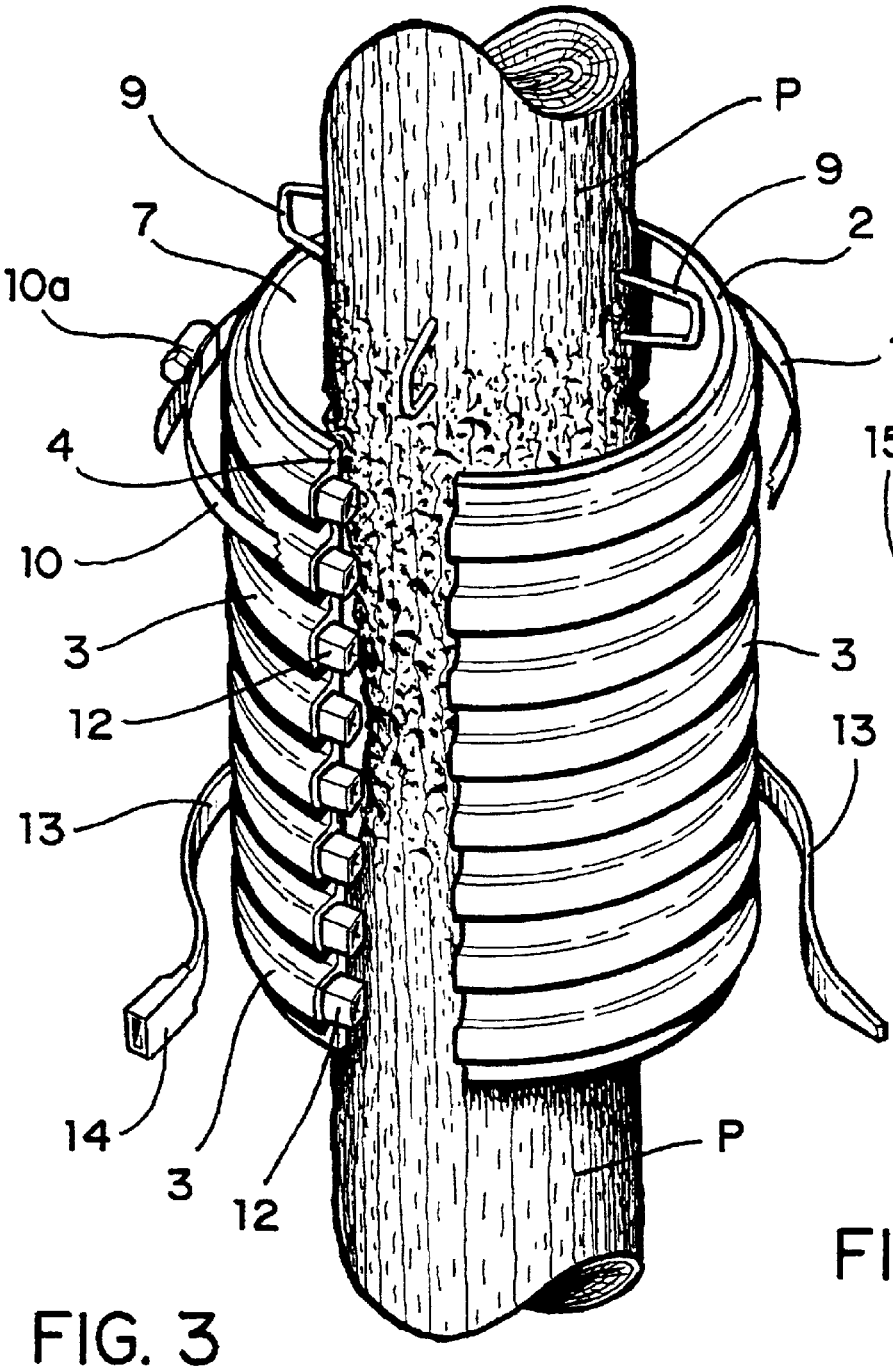
FIG. 3 is a somewhat different embodiment of FIG. 2.

Turning now to FIG. 3, there is shown a similar jacket 1 of FIG. 2 but with some preferred modifications It is clear that when installing a jacket 1 around a pile P that there always should be at least two bandings 10. Another type of banding is shown at 13. This banding is also well known. It is made of a plastic material and has a non-reversing or one-way buckle 14. FIG. 3 also illustrates the use of form-fitting plugs 12 which are pressed into the interior of each of the corrugations of one of the edges and are received in the same manner in the other interiors of the other corrugations of the other edge. This will assure a rigid fit between the longitudinal edges 4 of the jacket 1. These plugs also help in locating the edges 4 relative to each other in a self-aligning manner when the jacket is installed. After all, the assembly takes place in an underwater environment and the visibility might be hampered.

Figure 3A:
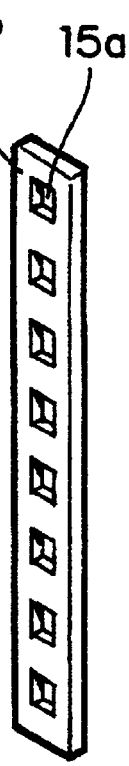
FIG. 3A shows a different seal for the edges of the jacket.

FIG. 3A shows a different seal 15 to be used between the edges 4 when they are closed. This seal 15 is a rectangular seal but having openings 15*a* therein to accommodate the plugs 12 there through when the plugs 12 enter the openings in the corrugations.

Figure 4:
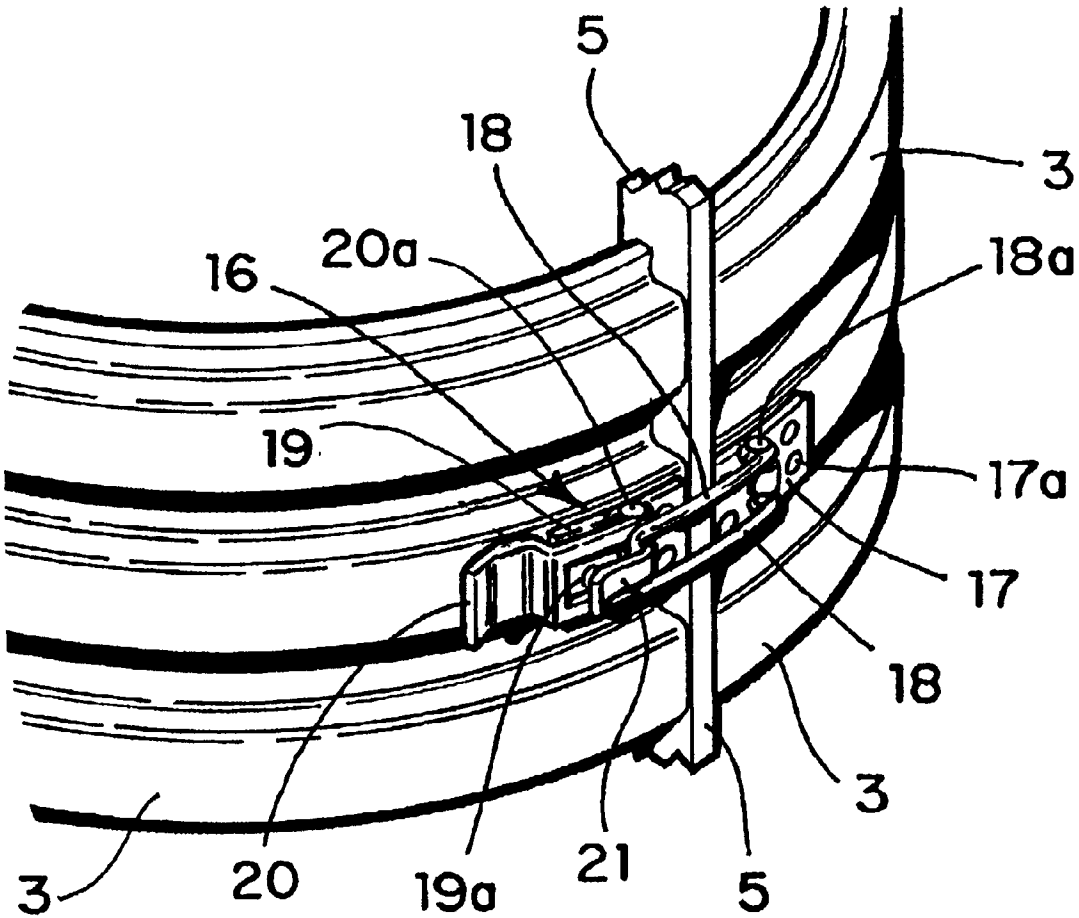
FIG. 4 illustrates a construction of closing the edges of the jacket.

Turning now to FIG. 4 which shows a different fastening system for closing the jacket onto its edges 4. This fastening system consists of a buckle system 16 of the over center type. To this end, the buckle 16 includes two plates 17 and 19 which are riveted by rivets 17*a* and 19*a*, respectively, to the top or outside surfaces of the respective corrugations 3. Plate 17 has a longitudinal hasp 18 mounted thereon which is pivotal around pivot 18*a*. The other plate 19 has a pivotal handle 20 mounted thereon which is pivotal around pivot 20*a*. The handle 20 also carries a hook 21 thereon. When it is desired to lock the two edges 4 of the jacket together including the seal 5, the hasp 18 is placed within the hook 21 on handle 20 and the handle 20 is then moved to a closed position, as shown in FIG. 4, whereby the hook 21 pulls the hasp 18 and thereby the edges 4 together until the hook 21 is pulled past the pivot 20*a* which position is over the center of the buckle system 16. This assures a secure lock. Of course, two such buckle systems need to be used, one at the top of the jacket and a second one at the bottom. The advantage is this type fastening system is that it can be used repeatedly in many different installations. Another advantage resides in the fact that no tools are required to lock the edges 4 together which greatly enhances the use in an underwater assembly. Another advantage lies in the fact that this installation can be a one man operation. All of the above lessens the cost of the installation and the assembly is quicker to perform.

Figure 5:
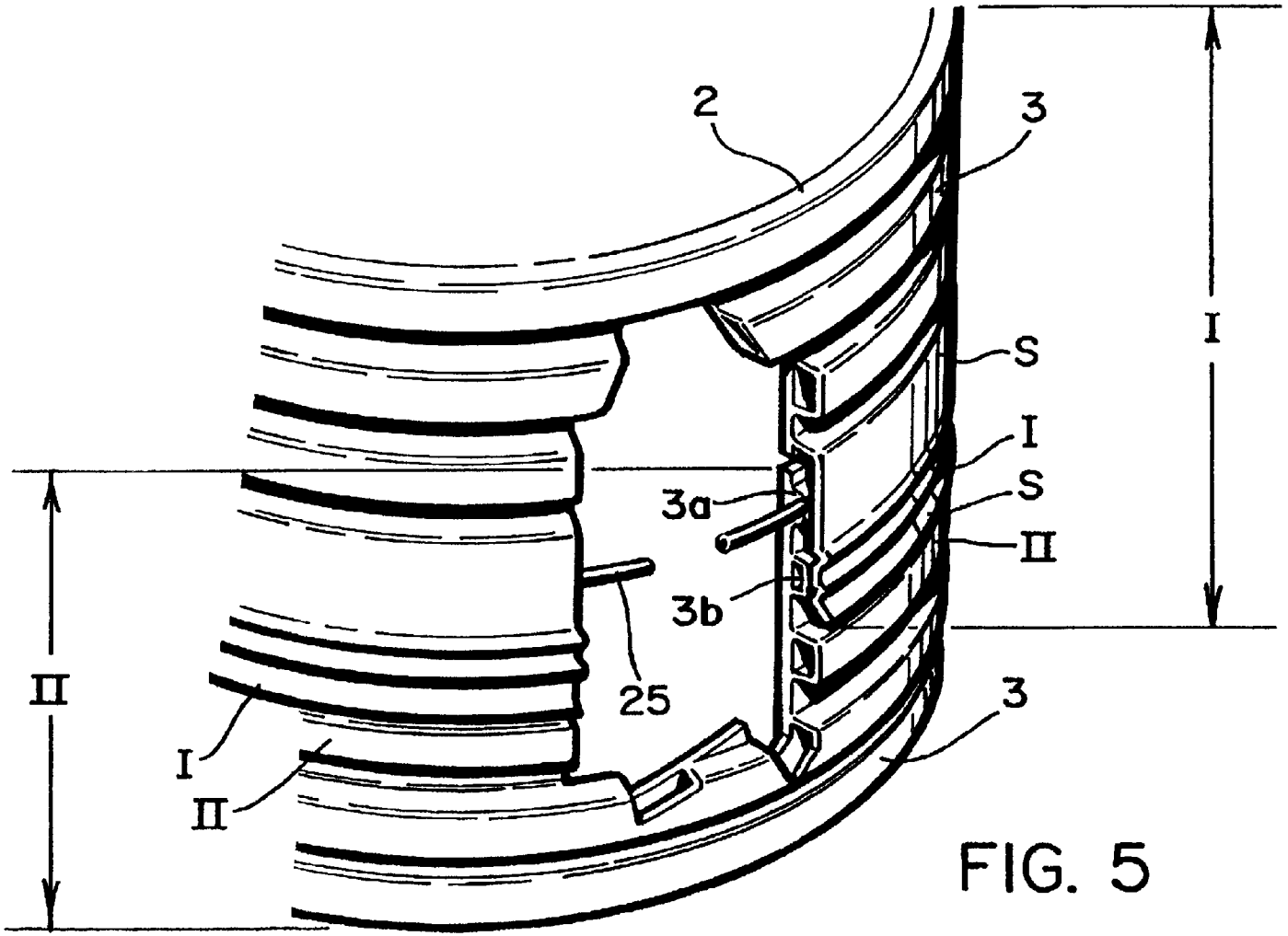
FIG. 5 shows a bell and spigot arrangement of connecting two units.

FIG. 5 illustrates how two jackets are connected together through the use of a bell and spigot system. Lines and arrow I denote the lower section of the upper jacket, while lines and arrow II denote the upper section of the lower jacket. The lower section of the upper jacket has an extension or bell S which overlaps the first two annular corrugations of the upper section of the lower jacket. For this purpose, the two annular corrugations 3*a* and 3*b* are somewhat reduced in circumferential size so that the extension S can slip over the same. The corrugation 3*a* also has the seal 25 embedded in its outer surface to assure a tight seal between the two jackets.

Figure 6:
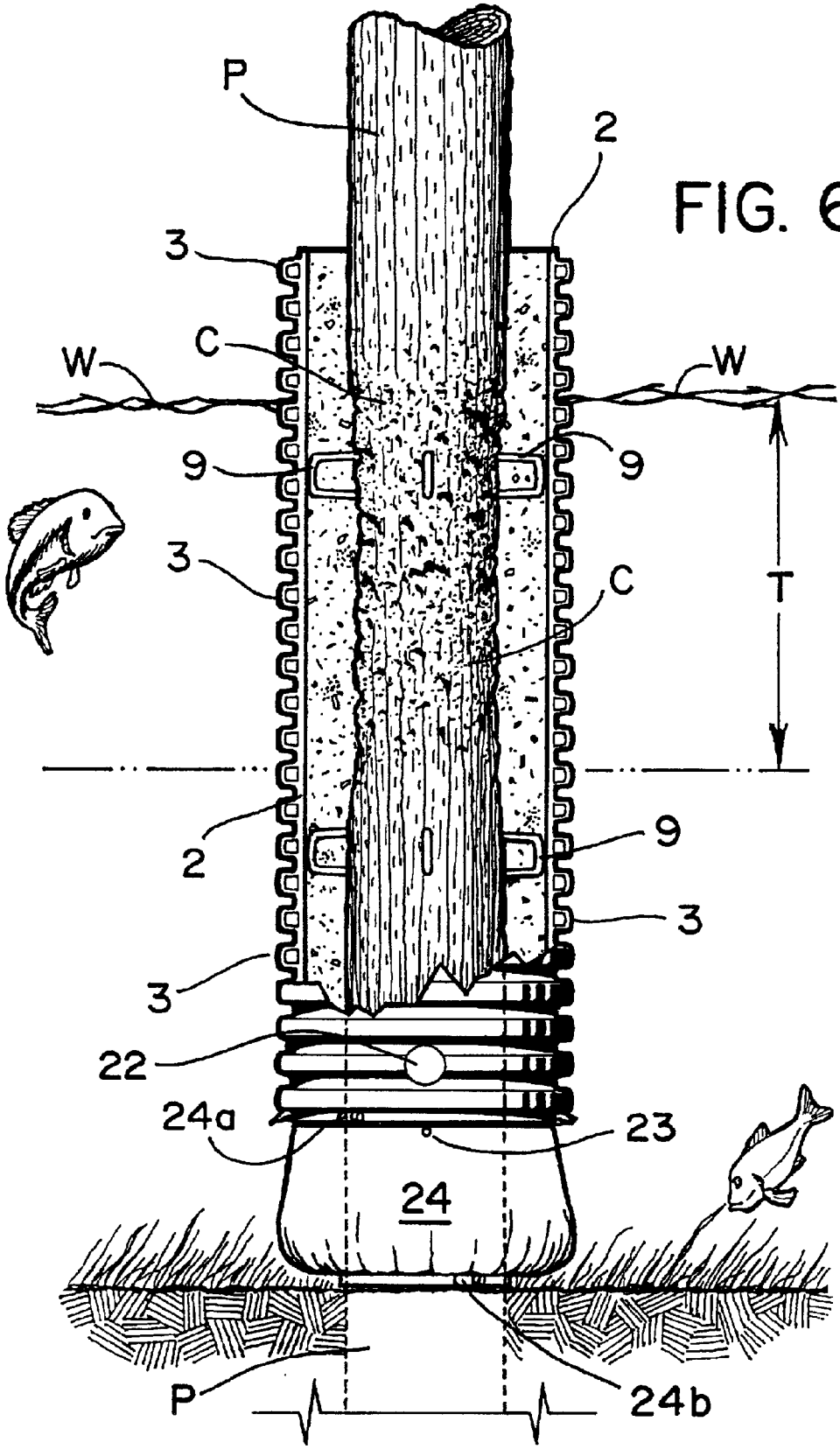
FIG. 6 illustrates an installation of the jacket within a tidal zone.

FIG. 6 illustrates a complete installation of the jacket on a limited extent of the underwater pile P. Any installation contemplated above ground would follow the same assembly steps. In the previously described jackets, above, it was assumed that the jacket would completely cover the pile P all the way to and below the mud line of the body of the water. FIG. 6 only repairs or rehabilitates only part of the pole P. It is a well known fact that most of the damage to a timber pile occurs at the wave line W and within the tidal zone T. The corrosion has been indicated by C. To this end, a jacket 1 is installed over the deteriorated section C and is stabilized laterally by standoffs 9. The bottom of the jacket is stabilized relative to the height of the pile P by spikes 23 driven into the pile or otherwise fastened to the pile. In order to completely close the bottom of the jacket 1 against the loss of concrete, a Nylon fabric bag 24 is installed. The bag 24 is banded within a valley of the last corrugations 3 of the jacket 1 through the use of banding 24*a* and the lower end of the bag is banded against the pole P itself through the use of banding 24*b*. The numeral 22 indicates a port for the entry of concrete. It is a known fact that concrete should be introduced into the interior of the jacket at a bottom thereof. This will force the water therein upwardly and furthermore avoid air bubbles from forming within the concrete.

Figure 7:
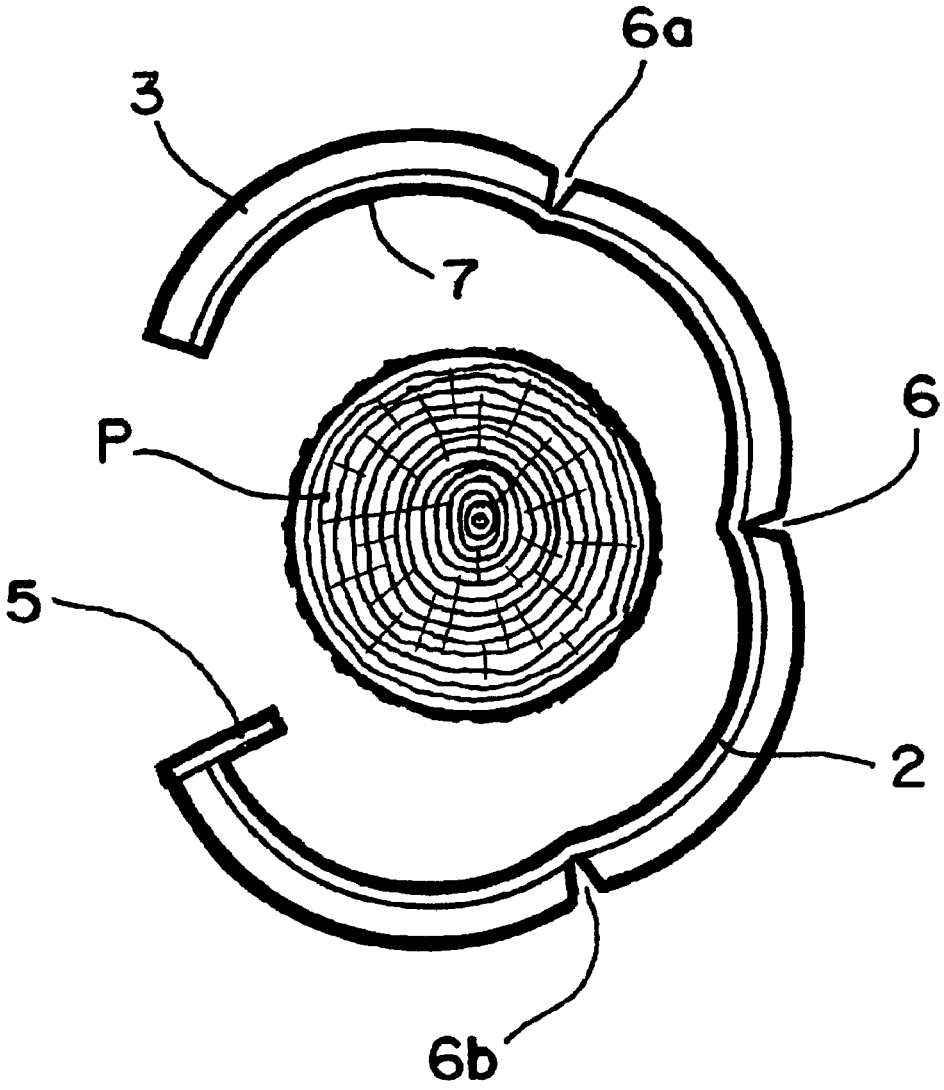
FIG. 7 is a top view of a modified jacket form of FIG. 1.

Turning to FIG. 7, there is shown a repair jacket form having at least three V-shaped cuts 6, 6*a* and 6*b* made through the corrugations 3. In some repair undertakings, larger piles in circumference are encountered including square concrete piles that require the repair jacket form to be opened rather wide. This might overstress the material tolerance of just a single live hinge. Therefore, the presence of three live hinges 6, 6*a* and 6*b* will considerably alleviate the overstressing.

Figure 8:
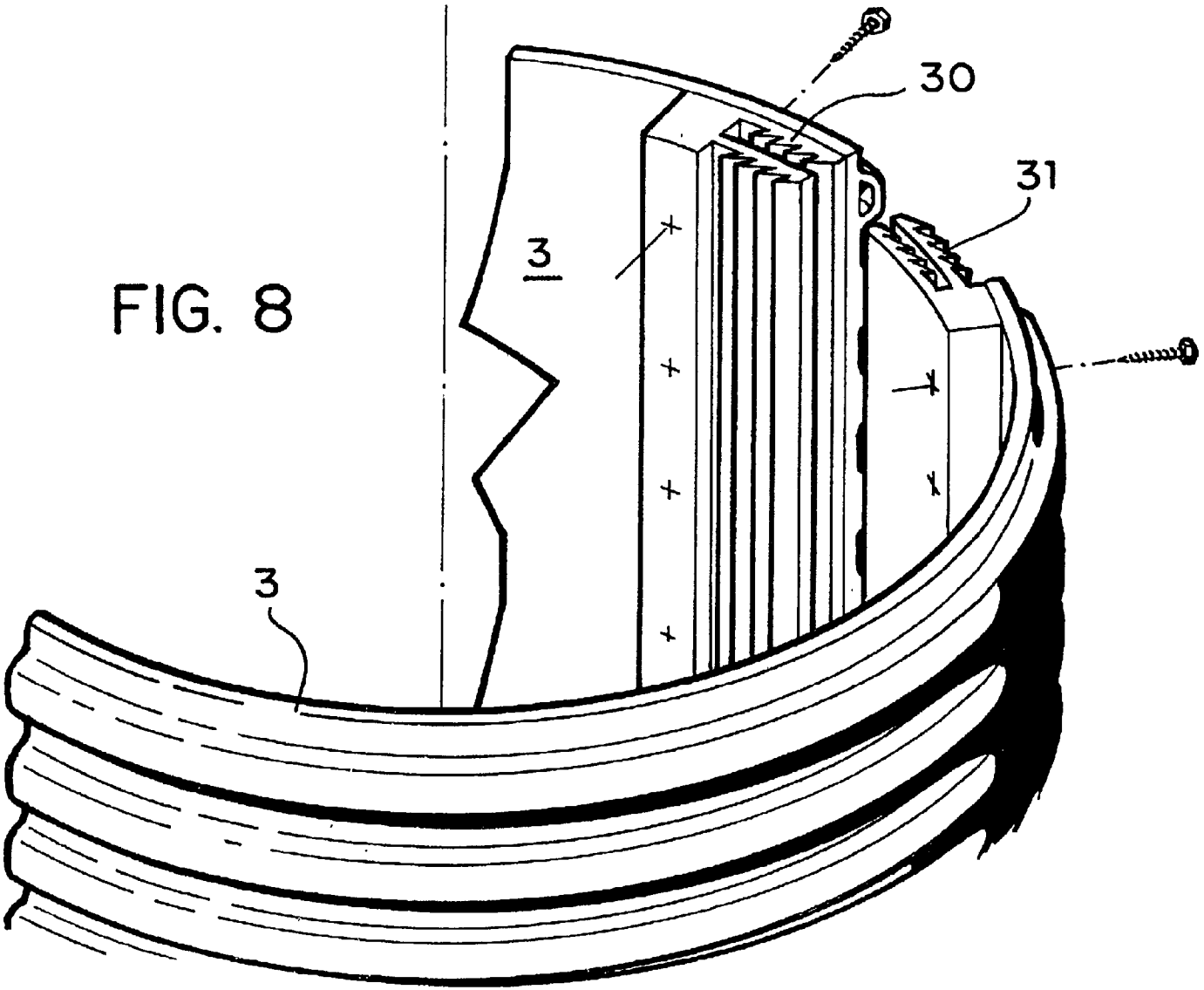
FIG. 8 is a perspective view of a modified edge connection.

FIG. 8 illustrates a different system of connecting the edges of the jacket 3 together. It has been found that when long or tall columns are being used and when they are tilled with concrete, the lower end of the column, especially at their edges does not want to stay in form because of the accumulated weight of the concrete. This problem is being alleviated through the use of the connectors 30 and 31 shown in both FIGS. 8 and 9. The connectors 30 and 31 can easily be extruded from a plastic material of the some composition from which the jackets are made. The connectors can easily be fastened to the inside surface of the jacket 3 by fasteners shown in FIG. 8. As can be seen in FIG. 8, the female connector 30 is installed with its socket edge flush with the edge of the jacket. The male connector 31 is installed with its projecting part protruding from its base and is ready to be received within the female socket of connector 30. In this manner, both opposing edges of the jacket will be abutting each other and will be form-fitting.

Figure 9:
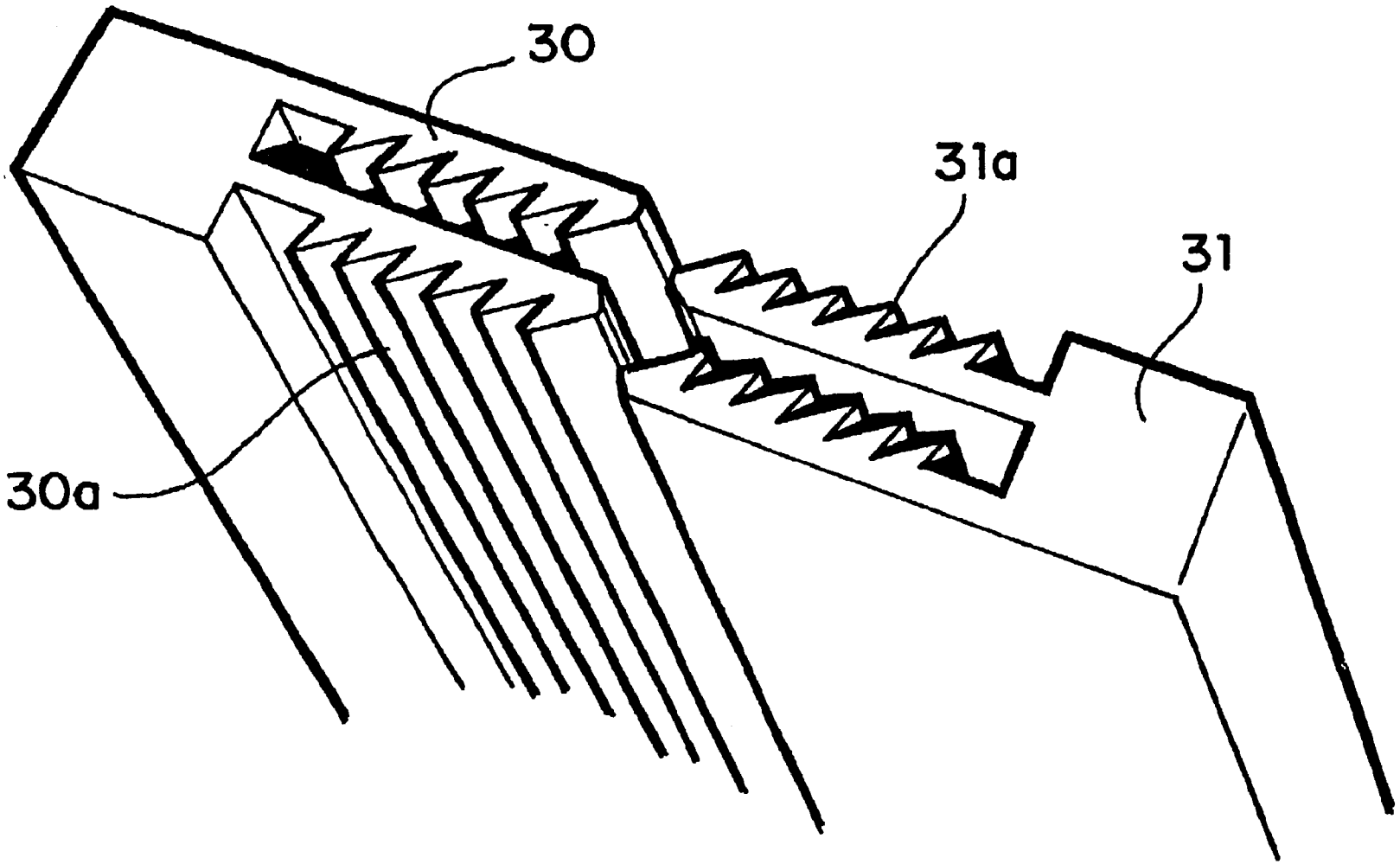
FIG. 9 is a detailed view of a modified connection.

Turning now to FIG. 9, the structural details of the connectors 30 and 31 are shown. The male as well as the female are double serrated and the serrations are opposing each other. Once the serrations are inserted into each other they will form a planar surface facing at the interior of the jacket. Experiments have shown that this type of connector solves the problem of the jacket edges opening at any length or

SUMMARY OF THE INVENTION

From all of the above, it can now be seen that the repair or rehabilitation of an underwater as well as an above ground support pile has greatly been simplified with a lower cost realization. The jacket forms disclosed herein can be reused many times over or the jacket forms can be left in situ which may prolong the life of the installation indefinitely. The installation has been simplified and speeded up to thereby save cost in labor. These were the objects of the invention.

What we claim is:

1. A support pile repair jacket form made of a plastic material comprising a solid wall cylinder having annular corrugations on its exterior surface, a longitudinal cut made through said solid wall and through said corrugations to thereby expose edges of said wall and said corrugations, a V-shaped cut made into said corrugations opposite from said longitudinal cut to said solid wall thereby creating a live hinge in said plastic material, a longitudinal seal placed on at least one edge of said edges, means for pulling said edges together and fastening said edges into a tight relationship, wherein said plastic material is made of a transparent material to facilitate a view of an interior of said jacket.

2. The support pile repair jacket form of claim 1, wherein said seal is self-adhering on one side thereof.

3. The support pile repair jacket form of claim 1, wherein said seal has a multiple of integral protruding plugs on one of its sides, each of said plugs is form-fitting into the interior of each of said corrugations of said other edge.

4. The support pile repair jacket form of claim 1, wherein said seal has a multiple of protruding plugs on each of its sides, each of said plugs is form-fitting into the interior of each of said corrugations on both edges of said jacket.

5. The support pile jacket form of claim 4, wherein said seal has a lateral extension extending into the interior of said pile jacket form and wherein said lateral extension has lateral holes there through.

6. The support pile repair jacket form of claim 1 including protruding form-fitting plugs in each of the interiors of said corrugations on one of said edges, said protruding plugs forming means for orienting said edges of said wall by entering each of said protruding plugs into the interior of said corrugations on the other of said edges of said wall.

7. The support pile repair jacket form of claim 1, wherein said seal is of a rectangular shape and has openings therein of such a size and spacing to receive said protruding plugs there through.

8. The support pile repair jacket form of claim 1, wherein said means for tightening consists of a band of the ratchet type surrounding said jacket.

9. The support pile repair jacket form of claim 1, wherein said means for tightening consists of a plastic band having a one way buckle at one end thereof and surrounding said jacket.

10. The support pile repair jacket form of claim 1, wherein said means for tightening consists of at least two parts of an over center buckle type, one of said parts is fastened to an outside surface of one corrugation and the other of said parts is fastened to the outside of opposing corrugations on said edges of said wall.

11. The support pile repair jacket form of claim 1 including standoffs between an interior of said cylindrical wall and said pile.

12. The support pile repair jacket form of claim 1, wherein at least two of said jackets forms are combined into one unit by a bell an spigot system including a seal within said system.

13. The support pile repair jacket form of claim 1, wherein said repair jacket is installed on a support pile which is located on a ground.

14. The support pile jacket form of claim 1 including V-shaped cuts made through said corrugations onto said wall in at least three locations.

15. A system for repairing an underwater pile having a corrosion area between the wave action of a body of water and a high and low tidal zone comprising a repair jacket form surrounding said pile, said repair jacket form consisting of a plastic cylindrical wall having annular corrugations on an exterior surface thereof and further having a longitudinal cut along its length to create opposing edges, a V-shaped cut placed through said annular corrugations onto said wall to thereby create a living hinge in said plastic cylindrical wall, a seal placed between said opposing edges, means for bringing said edges together into an intimate relationship with said seal trapped there between, means for closing a bottom of said jacket including a bag made of nylon material, means for fastening said bag of nylon between at least two of said corrugations and a circumference of said pile, wherein said plastic cylinder is made of a transparent material to allow a visual observation of an interior of said cylinder.

16. The system for repairing an underwater pile of claim 15 including spikes driven into said pile to support a bottom of said jacket form at a predetermined height above a mud line of said body of water.

17. The system for repairing an underwater pile of claim 15, wherein said means for fastening said nylon bag consists of bands surrounding said jacket and said pile, respectively, to trap said nylon bag there between.

18. The system for repairing an underwater pile of claim 15 including a concrete inlet port at a bottom of said jacket form.

19. The system for repairing an underwater pile of claim 15, including standoffs between an interior surface of said cylindrical wall and said pile.

20. The system for repairing an underwater pile of claim 19, wherein said standoffs are made of a non-metallic material.

21. The system for repairing an underwater pile of claim 19, wherein said standoffs consist of a plastic material.

22. A support pile repair jacket form made of a plastic material comprising a solid wall cylinder having annular corrugations on its exterior surface, a longitudinal cut made through said solid wall and said corrugations to thereby oppose edges of said wall and said corrugations, a V-shaped cut made into said corrugations opposite from said longitudinal cut to thereby creating a live hinge in said plastic material, a longitudinal seal is placed on the interior of and at each of said edges, each of said seals having serrations that fit into each other and lock said seals together, means for fastening said seals to said wall.

23. The support pile repair jacket of claim 22, wherein each of said seals has double serrations spaced from each other to thereby form sockets fitting into each other.

* * * * *